United States Patent [19]

MacKay

[11] Patent Number: 4,754,900

[45] Date of Patent: Jul. 5, 1988

[54] METHOD OF AND APPARATUS FOR DISPENSING A CONTROLLED AMOUNT OF A LIQUID METAL

[75] Inventor: Colin A. MacKay, Austin, Tex.

[73] Assignee: Microelectronics and Computer Technology Corporation, Austin, Tex.

[21] Appl. No.: 111,881

[22] Filed: Oct. 23, 1987

[30] Foreign Application Priority Data

Mar. 12, 1986 [GB] United Kingdom ..... 8628970

[51] Int. Cl.[4] ..... B22D 39/02

[52] U.S. Cl. ..... 222/590; 222/593

[58] Field of Search ..... 222/590, 593; 228/180.1, 180.2; 437/183, 203

[56] References Cited

U.S. PATENT DOCUMENTS

| | | | |
|---|---|---|---|
| 4,339,508 | 7/1982 | Tsuya et al. | 222/593 |
| 4,566,525 | 1/1986 | Li et al. | 222/593 |

FOREIGN PATENT DOCUMENTS

| | | | |
|---|---|---|---|
| 27329 | 2/1983 | Japan | 437/183 |
| 208751 | 11/1984 | Japan | 437/183 |
| 23329 | 1/1986 | Japan | 437/183 |

*Primary Examiner*—L. Dewayne Rutledge
*Assistant Examiner*—Robert L. McDowell
*Attorney, Agent, or Firm*—Fulbright & Jaworski

[57] ABSTRACT

A controlled volume of a liquid metal is dispensed from a ceramic capillary tube. A wetted film of the liquid metal is applied to the tip of the tube and the liquid metal is inserted into the interior of the tube. The tube contacts a receiving surface with the wetted film and ultrasonic energy is applied to the tube to dispense a small control volume with extreme precision.

11 Claims, 2 Drawing Sheets

METHOD OF AND APPARATUS FOR DISPENSING A CONTROLLED AMOUNT OF A LIQUID METAL

BACKGROUND OF THE INVENTION

The present invention is directed to a method and means for dispensing liquid metals in small controlled volumes with extreme precision. For example, it is desirable to dispense small quantitative volumes of liquid or molten metal precisely onto small areas such as an electronic substrate, electronic chip bumps, or tape automated bonding (TAB) lead-ins for use in bonding, such as by thermal or laser bonding, of other components to the dispensed metal.

SUMMARY

The present invention is directed to dispensing a controlled amount of a liquid metal by providing a capillary tube for receiving the liquid metal in which an ultrasonic transmitting means is connected to the capillary tube and a wetted film of the liquid metal is applied to the bottom of the capillary tube. When the wetted film contacts a receiving surface and the capillary tube is ultrasonically vibrated, a controlled volume of the metal is dispensed on the receiving surface. Preferably, the capillary tube is ceramic or glass.

Yet a further object of the present invention includes means for heating the capillary tube wherein the liquid metal is a molten metal which is kept in the liquid state by heat.

Still a further object of the present invention is wherein the diameter of the interior of the bottom tip of the capillary tube is approximately 0.002 inches for use in providing an extreme precision volume of liquid metal which is useful in bonding microelectrical components.

Yet a still further object of the present invention is the method of dispensing a controlled amount of a liquid metal which includes applying a wetted film of the liquid metal around the bottom tip of a capillary tube, inserting the liquid metal into the capillary tube, contacting a receiving surface with the wetted film of the capillary tube, and applying ultrasonic energy to the capillary tube.

A further object of the present invention is the provision of an apparatus and method of dispensing liquid metals such as mercury, gallium, gallium-indium eutectic, gallium-indium-tin eutectic, gallium-nickel, gallium-copper, and gallium-silver which are particularly useful in bonding one microelectrical conductor to a second microelectrical conductor.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENTS

While the present invention is useful in dispensing small volumes of liquid metals with great precision for various uses, the present invention will be described, for purposes of illustration only, as dispensing a liquid metal onto one microelectrical conductor for bonding to a second microelectrical conductor.

Figure 1:
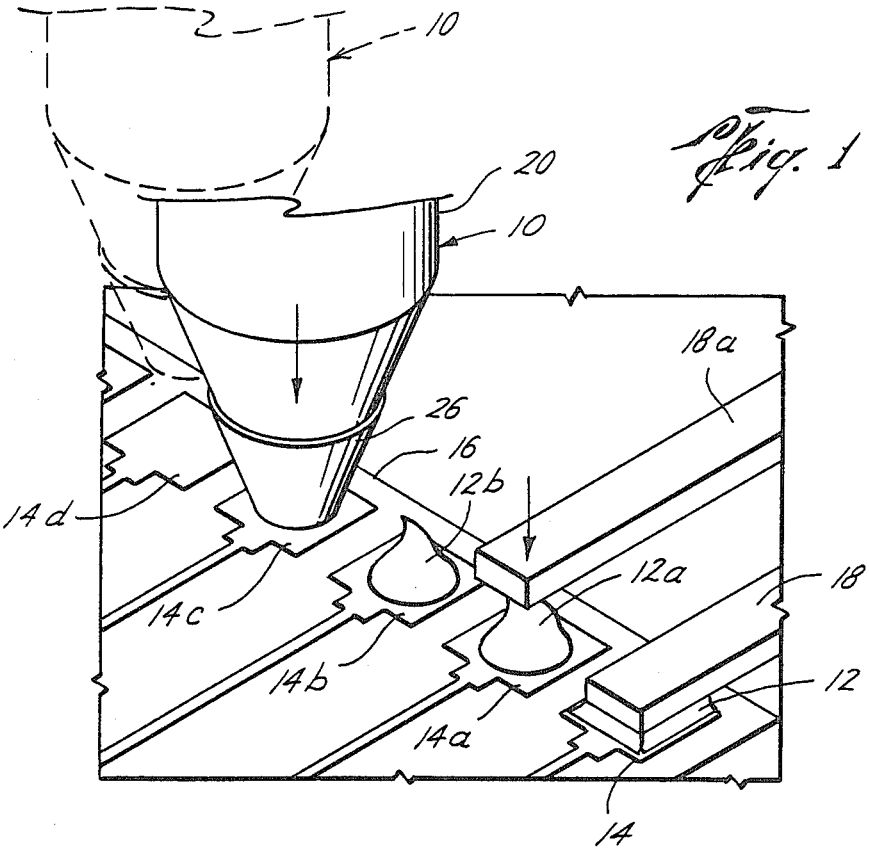
FIG. 1 is a fragmentary perspective view illustrating the use of the present invention in dispensing individual spots of a liquid metal.

Referring now to the drawings, and particularly to FIG. 1, the present invention is generally indicated by the reference numeral 10 for dispensing a spot of liquid metal onto each of a plurality of first electrical conductors such as chip bumps 14, 14*a*, 14*b*, 14*c* and 14*d* of an integrated circuit 16 for allowing second electrical conductors to be bonded to the bumps, such as by conventional thermal or laser bonding. Because the electrical contacts of the first and second electrical conductors are micro sized, it is important that the dispensed liquid metal spots be placed accurately and in carefully controlled volumes. In FIG. 1, the dispensed metal spot 12 is shown as having been deposited and bonded between the bump 14 and the lead 18. Liquid metal spot 12*a* has been deposited onto bump 14*a* and lead 18*a* is being moved into engagement with the metal spot 12*a* for bonding, spot 12*b* has been deposited on bump 14*b*, and the apparatus 10 is in position for dispensing a liquid metal spot onto the bump 14*c*.

Figure 3:
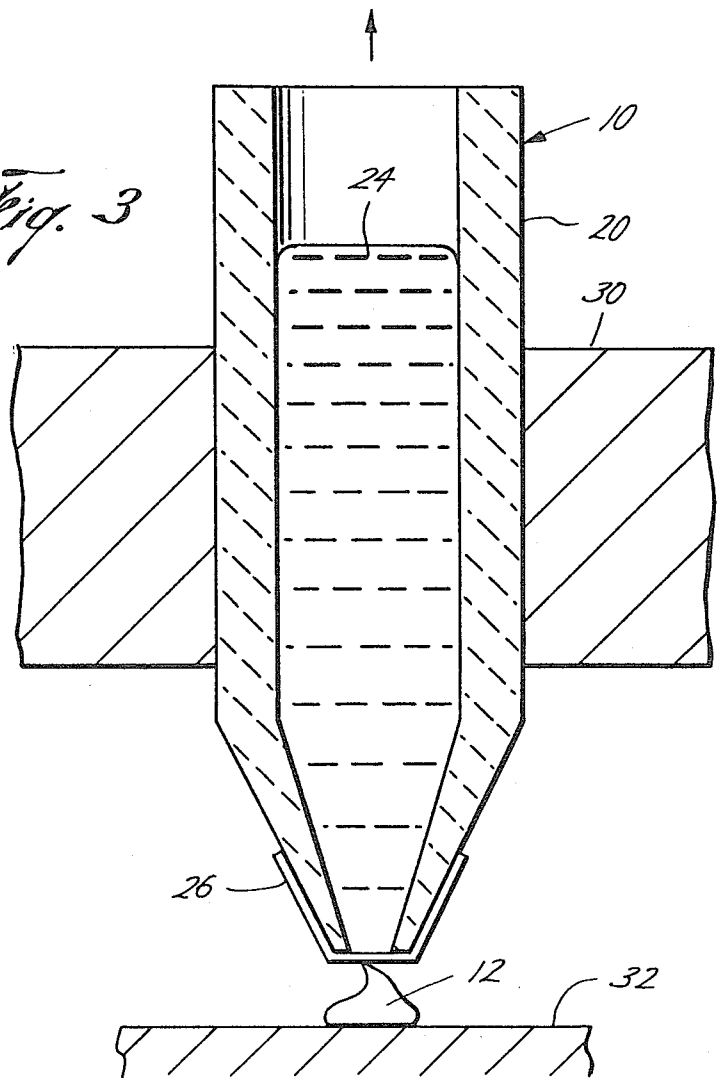
FIG. 3 is a view similar to FIG. 2 with the apparatus moving away from the receiving surface and dispensing a small volume of liquid metal.
Figure 2:
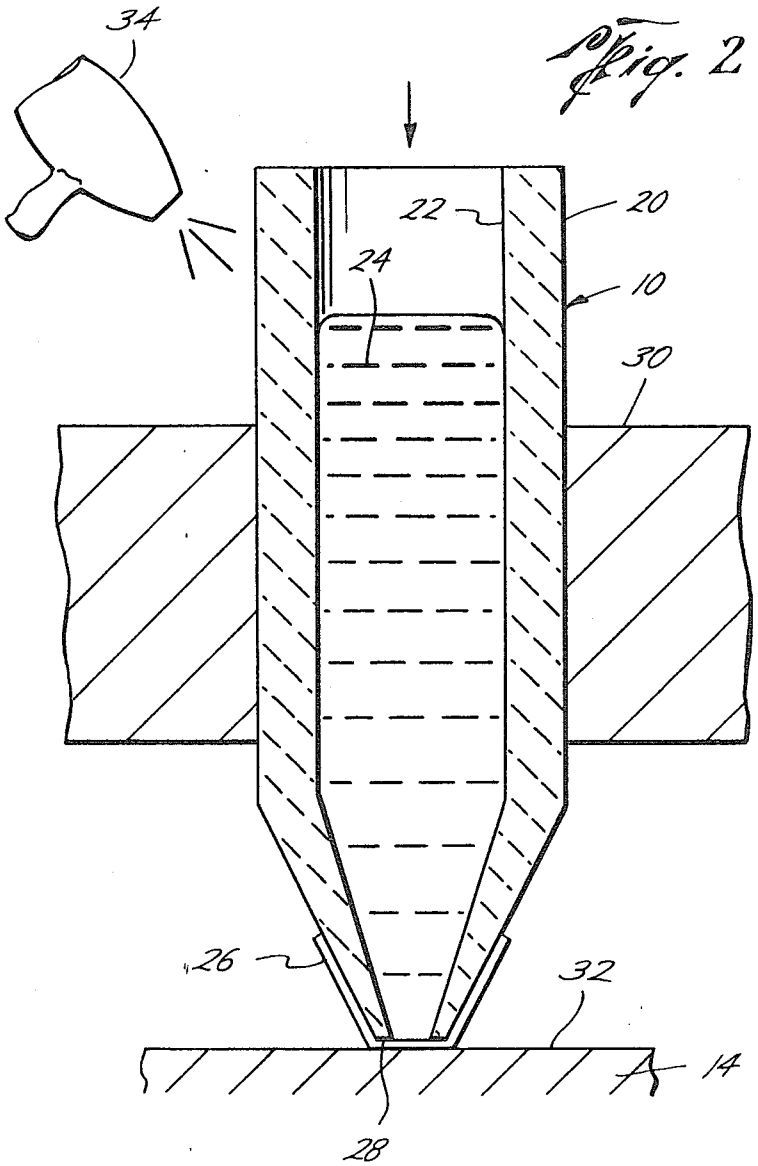
FIG. 2 is a fragmentary elevational view of the apparatus of the present invention contacting a receiving surface.

Referring now to FIGS. 2 and 3, the dispensing apparatus 10 of the present invention includes a capillary tube 20 which may be of any suitable material, such as ceramic or glass and includes an interior 22 in which a liquid metal 24 may be placed. A wetted film 26 is applied to the bottom or the tip 28 of the capillary tube 20 and is of the same type of liquid metal as the liquid metal 24 being dispensed. The wetted film may be provided by dipping the tip 28 into a container of the liquid metal 24.

An ultrasonic vibration arm 30 is connected to the capillary tube 20 for applying ultrasonic energy to the capillary tube 20. For example, the capillary tube 20 and ultrasonic vibrating arm 30 may be part of a wire bonder such as K & S Model 2401 or IMI Model 1310 which has been adapted for use as a liquid metal dispenser.

After the capillary tube 20 has received the liquid metal 24 and the tip 28 has been provided with the wetted film 26, the apparatus 10 is ready for dispensing a controlled amount of the liquid metal 24 onto a receiving surface 32. The capillary tube is moved downwardly to move the film 26 into engagement with the receiving surface 32 of an electrical conductor, such as bump 14, and ultrasonic energy is applied to the capillary tube 20 by the arm 30. This provides wetting of the receiving surface 32 and dispenses a small diameter spot of liquid metal 12, as best seen in FIG. 3, as the capillary tube 20 is retracted from the receiving surface 32. Generally, the shape of the dispensed spot 12 is a pyramid-shaped mass generally in the form of a "Hershey Kiss". The size of the spot 12 is dependent upon the diameter of the interior of the capillary tube 20 and the film thickness of the wetting film 26. For example, when the diameter of the interior of the capillary tube at the tip is approximately 0.002 inches, spots 12 with an average diameter of 0.160 inches with a standard deviation of plus or minus 0.020 inches are dispensed. Satisfactory dispensing of liquid metal spots using capillary tips of 0.0015 and 0.0020 inches in diameter have been performed. While, of course, the diameter of the entire interior of the capillary tube may be the same as the diameter of the tip, it is preferable that the diameter of the capillary tube increase from the tip in order to hold a sufficient amount of liquid metal 24 for manufacturing convenience.

Various types of liquid metals and amalgams have been dispensed. Liquid metals which are useful for bonding one electrical conductor to a second electrical conductor may include mercury, gallium, gallium-indium eutectic, gallium-indium-tin eutectic, gallium-nickel, gallium-copper, and gallium-silver. Furthermore, the liquid metal 24 being dispersed may be a molten liquid metal in which the metal on the interior 22 of the capillary tube 20 is kept in a molten state by any suitable means for heating the capillary tube 20. Such means may include a heating coil about the capillary tube 20 or preferably, as shown, a hot air gun 34 directing hot air onto the capillary tube 20 or an R.F. induction coil etc.

Figure 4:
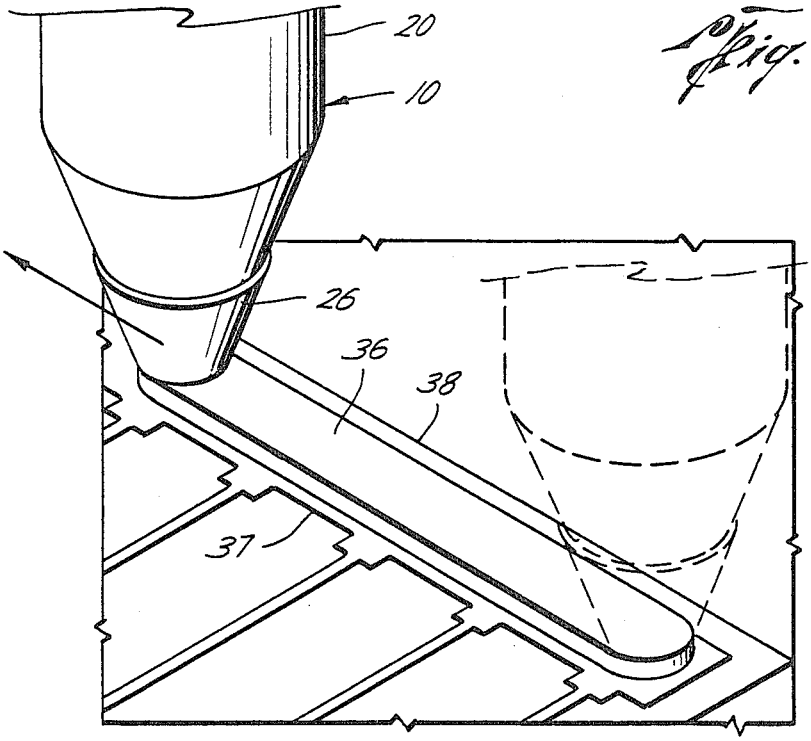
FIG. 4 is a perspective elevational view of the present invention dispensing a liquid metal in linear form.

While the present apparatus 10 is useful for dispensing small precision spots 12, the apparatus 10, as seen in FIG. 4, may also provide and dispense a line of liquid metal 36 onto a conductor 37 on substrate 38 by moving the tip 28 of the capillary tube 20 along the substrate 38 while applying ultrasonic energy. The line 37 may then be connected to another electrical conductor (not shown). The method of the present invention is apparent from the foregoing description of the apparatus, but the method includes dispensing a controlled amount of a liquid metal by applying a wetted film of the liquid metal around the bottom tip of a capillary tube, inserting the liquid metal into the capillary tube, contacting a receiving surface with the wetted film of the capillary tube, and applying ultrasonic energy to the capillary tube.

The present invention, therefore, is well suited to carry out the objects and attain the ends and advantages mentioned as well as others inherent therein. While a presently preferred embodiment of the invention has been given for the purpose of disclosure, numerous changes in the details of construction, and arrangement of parts, and steps of the process, will be readily apparent to those skilled in the art and which are encompassed within the spirit of the invention and the scope of the appended claims.

What is claimed is:

1. An apparatus for dispensing a controlled amount of a liquid metal comprising, a capillary tube for receiving a liquid metal, an ultrasonic transmitting means connected to the capillary tube, and a wetted film of said liquid metal applied to the bottom of the capillary tube whereby when the wetted film contacts a receiving surface and the capillary tube is ultrasonically vibrated a controlled volume of metal is dispensed on the receiving surface.

2. The apparatus of claim 1 wherein the capillary tube is ceramic.

3. The apparatus of claim 1 wherein the capillary tube is glass.

4. The apparatus of claim 1 including means for heating the capillary tube.

5. The apparatus of claim 1 wherein the diameter of the interior of the capillary at the bottom is approximately 0.002 inches.

6. A method of dispensing a controlled amount of a liquid metal comprising, applying a wetted film of the liquid metal around the bottom tip of a capillary tube, inserting the liquid metal into the capillary tube, contacting a receiving surface with the wetted film of the capillary tube, and applying ultrasonic energy to the capillary tube.

7. The method of claim 6 wherein the capillary tube is ceramic.

8. The method of claim 6 wherein the capillary tube is glass.

9. The method of claim 6 wherein the diameter of the interior of the tip of the capillary tube is approximately 0.002 inches.

10. The method of claim 6 including heating the capillary tube.

11. The method of claim 6 wherein the liquid metal is selected from a group consisting of mercury, gallium, gallium-indium eutectic, gallium-indium-tin eutectic, gallium-nickel, gallium-copper, and gallium-silver.

* * * * *